US006830084B1

(12) United States Patent
Friede

(10) Patent No.: US 6,830,084 B1
(45) Date of Patent: Dec. 14, 2004

(54) MACHINE FOR TREATING CONTAINERS COMPRISING A HERMETICALLY CLOSED SPACE

(75) Inventor: Peter Friede, Jork (DE)

(73) Assignee: KHS Maschinen-Und Anlagenbau Aktiengesellschaft, Dortmund (DE)

( * ) Notice: Subject to any disclaimer, the term of this patent is extended or adjusted under 35 U.S.C. 154(b) by 0 days.

(21) Appl. No.: 10/489,754

(22) PCT Filed: Sep. 13, 2002

(86) PCT No.: PCT/EP02/10293

§ 371 (c)(1),
(2), (4) Date: Mar. 16, 2004

(87) PCT Pub. No.: WO03/024860

PCT Pub. Date: Mar. 27, 2003

(30) Foreign Application Priority Data

Sep. 17, 2001 (DE) ..... 101 45 803

(51) Int. Cl.[7] ..... B65B 1/04
(52) U.S. Cl. ..... 141/144; 141/85; 141/93
(58) Field of Search ..... 141/144–152, 141/85–93; 134/169 R

(56) References Cited

U.S. PATENT DOCUMENTS 3,670,786 A 6/1972 Levin et al.
4,489,769 A 12/1984 Catelli
6,026,867 A 2/2000 Klari
6,481,468 B1 * 11/2002 Taggart ..... 141/85
6,755,224 B2 * 6/2004 Tawa et al. ..... 141/144

FOREIGN PATENT DOCUMENTS

DE 297 13 155 U1 2/2000
EP 0 405 402 A2 1/1991
EP 0 758 624 A1 2/1997

* cited by examiner

*Primary Examiner*—Steven O. Douglas
(74) *Attorney, Agent, or Firm*—Rankin, Hill, Porter & Clark LLP

(57) ABSTRACT

A rotary processing machine for beverage containers (1), including a carousel (7, 8) that revolves about a vertical axis (5) and is fitted with peripherally spaced processing sites (12) receiving the containers. The processing sites are configured in a sealed space that may be charged with a special atmosphere. The stationary surfaces (14, 15, 16) of the space are traversed by entry and exit conveyor elements (19, 22). The space assumes the shape of an annular tunnel (7, 8, 14, 15, 16) surrounding the carousel (7, 8) and is enclosed, on one hand, by the closed carousel surfaces (7, 8) and, on the other hand, by the stationary surfaces (14, 15, 16). The carousel surfaces and stationary surfaces subtending the tunnel seal each other off by two seals (17, 18) concentric with the axis (5).

4 Claims, 2 Drawing Sheets

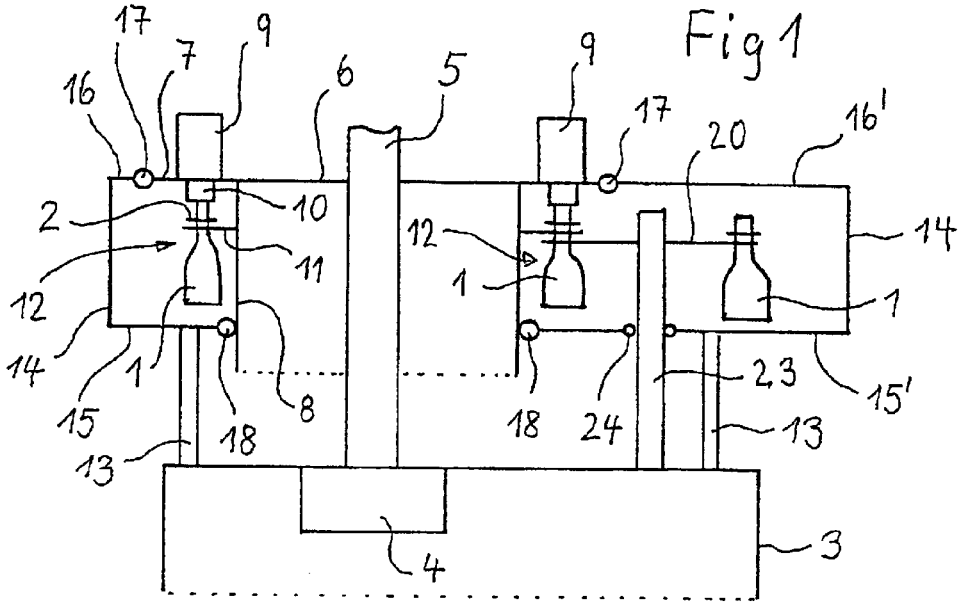
Fig 1
Fig 3
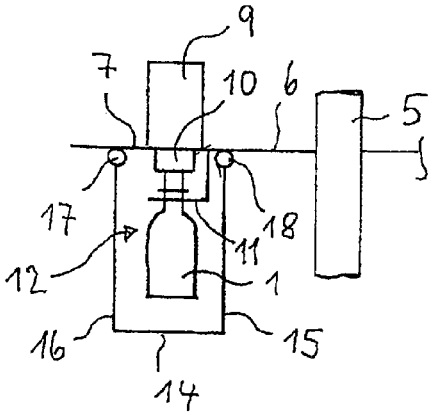
Fig 4
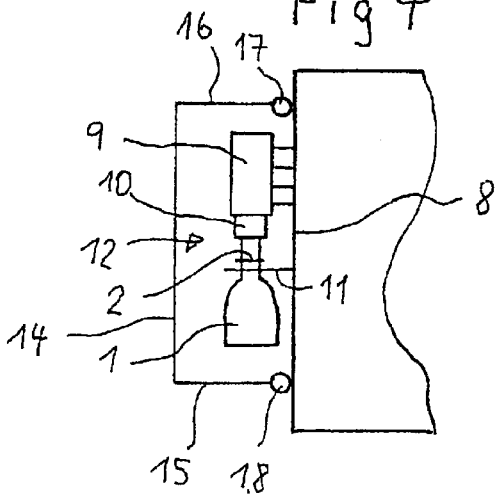

MACHINE FOR TREATING CONTAINERS COMPRISING A HERMETICALLY CLOSED SPACE

BACKGROUND OF THE INVENTION

The present invention relates to a rotary processing machine for beverage containers.

Container processing machines illustratively include filling machinery, sealing machinery, rinsing equipment and the like. Container processing machines are designed to be rotary when high output is desired. In rotary container processing machines, the processing sites receiving the containers are configured at the carousel periphery and move the containers during their processing in a revolving manner.

In order to meet the high requirements currently placed on the quality of the beverages being filled, designs exist wherein the processing sites are situated within a sealed space which may be filled with a special atmosphere. Said space may be loaded with an inert atmosphere, for instance $CO_2$ or with a sterilizing atmosphere of $H_2O_2$ and in this manner, the beverages may reliably contain only little oxygen or few germs, this feature being highly significant as regards their quality at the time of filling.

Processing machinery of that kind are known in many designs in the beverage industry.

The German patent 696,569 discloses a design of a filling machine within a closed kettle-like housing. The space so subtended is determined by the overall size of the said machine and entails a substantial volume.

The current and conventional typical design derives form Markus Rammert, "Keimarme Kaltfüllung stiller Getränke" (Low-germ, cold filling of still beverages), GETRÄNKEINDUSTRIE 8/96, pages 500–5. FIG. 4 on page 504 shows a standard design comprising a rinser/filler subassembly and associated transport devices within a housing which is accessible through doors and has the size of a modest single family house. The subtended space takes considerable volume.

A related design is disclosed in the 1997 ASEPTIC FILLING LINES brochure by PROCOMAC. The attempt is made in this instance to somewhat reduce the machinery components, but this endeavor succeeds only when these operate linearly. Rotary processing machinery of this design again entails a large housing of considerable volume.

A special design is disclosed in the German patent document 199 11 517 A1. This document discloses a rotary filling machine which is received, as a whole, in an omnidirectional and tightly enclosed housing of which the size again is determined by the machinery and therefore demands a considerable volume.

The German patent document 19835369 C1 discloses a special design where the container processing machines by their processing sites configured at the bottom project from above into a space filled with a special atmosphere. Said space underneath the said machine is passable to personnel and, accordingly, also subtends much volume.

The designs of the state of the art incur the drawback that the space loaded with a special atmosphere requires said substantial volume. Said space must be opened when there are operational problems. In such an event, the space fills with air and germs. The ensuing cleaning of said space before operation is allowed to resume substantially depends on said space's surfaces and total volume. As a result, as regards the known large spaces, interruption of operation caused by operational malfunctions, or required resetting of such machinery, will require at least several hours.

The objective of the present invention is to so design a processing machine of the above cited kind that operational interruptions caused by said space being contaminated shall be shortened.

This problem is solved by the present invention.

SUMMARY OF THE INVENTION

The space of the invention is configured as an annular tunnel of which the cross-section needs to do no more than merely allow the passage of the processing sites together with their containers. Said space therefore may be very small cross-sectionally. As a result, its inner surfaces and its volume are considerably reduced. When encountering operational difficulties which shall constrain opening the space or contaminate it in some other way, the ensuing cleaning time is much shorter than in known designs. Accordingly, the design of the present invention is economically reduced, the manufacturing costs are much lower than those of the bulky designs. The machine also is more compact. The invention is applicable both to single machines and to those used in sets.

The entry and exit wheels of the present invention are advantageous. In this manner, the entry and exit wheels also may be configured in the annular tunnel which includes a corresponding widening of its stationary surfaces at their peripheral locations.

BRIEF DESCRIPTION OF THE DRAWINGS

The invention is shown in illustrative and diagrammatic manner in the appended drawing.

FIG. 1 is a highly diagrammatic sectional view of a filling machine of the present invention through line 1—1 of FIG. 2 of said machine's axis of rotation.

DETAILED DESCRIPTION OF THE PREFERRED EMBODIMENTS

Figure 2:
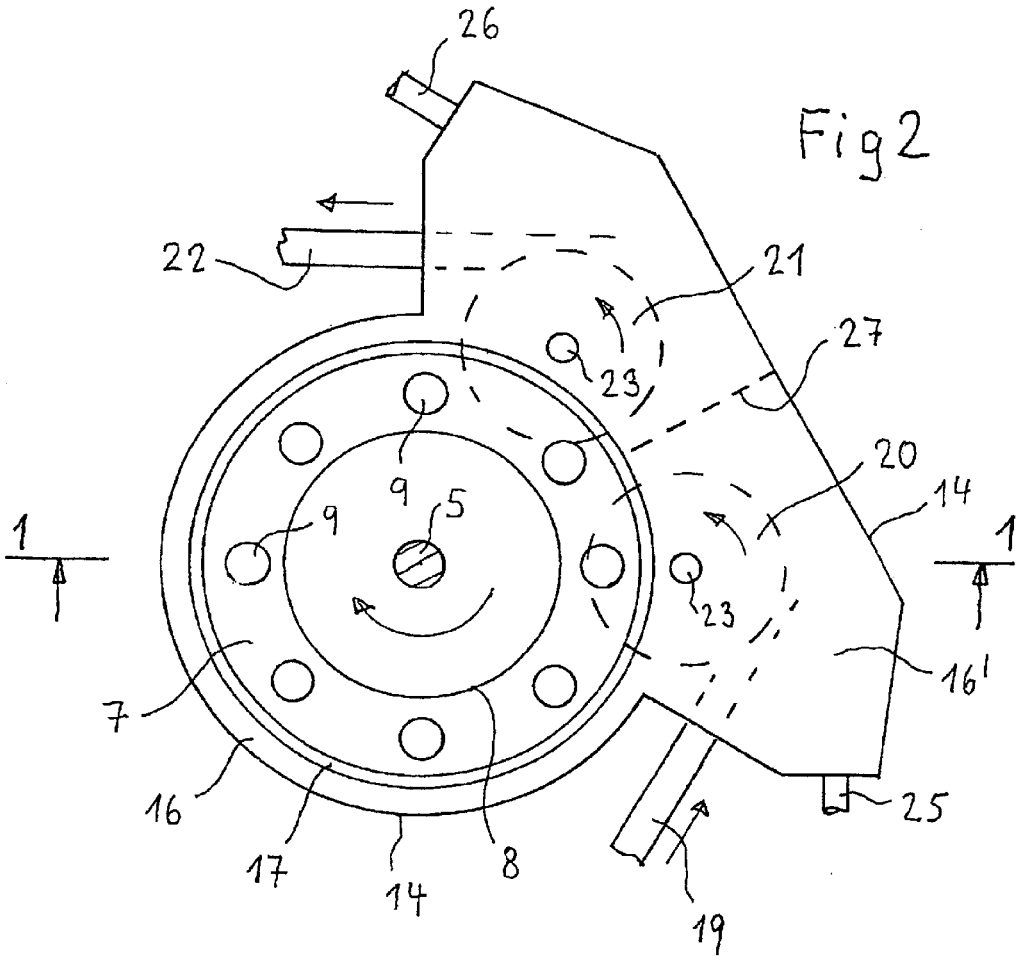
FIG. 2 is a top view of the machine of FIG. 1, and FIGS. 3, 4 are details of FIG. 1 with variations of the tunnel design.

FIG. 1 is a very diagrammatical section, showing the walls merely by dashes, through the axis of rotation of a filling machine which fills plastic bottles 1 fitted with the presently conventional collars 2 by which they are handled.

The filling machine shown in FIGS. 1 and 2 comprises a frame 3 resting on a floor (not shown), a post 5 driven by a motor 4 rising vertically upward from said frame 3. A carousel consisting of a horizontal annular wall 7 is affixed to the outer rim of a circular plate 6, which optionally is replaceable by spokes, and in this embodiment mode, said annular wall 7 may be integral with said circular plate. The carousel furthermore comprises a cylindrical wall 8 which is concentric with said post and also is set against the outer rim of the circular plate 6. The annular wall 7 and the cylindrical wall 8 are joined together in a sealing manner and each constitutes a closed wall.

The annular wall 8 is crossed in sealed manner by several filling devices 9 (FIG. 2) of which only the two in the sectional plane are shown for visual simplification in FIG. 1. By their discharge elements 10 fitted with the container seal, the filling devices 9 project below the annular wall 7. One conventional support 11, enclosing by a U-shaped clearance the neck of the bottle 1 below its collar 2, is assigned to each filling element and is affixed to the cylindrical wall 8. The discharge element 10 and the support 11 subtend at each filling device 9 a processing site 12 in the angle between the annular wall 7 and the cylindrical wall 8. The carousel 7, 8 is enclosed by a stationary wall on rests 13, said wall in this embodiment mode being made up of wall segments 14, 15, 16 at angles to each other as indicated in the drawing. The stationary wall 14, 15, 16 annularly encloses the carousel 7, 8 and is sealed at its annular ends by O-rings 17, 18, while allowing sliding motion, on one hand, relative to the outer rim of the annular wall 7 and, on the other hand, relative to the cylindrical surface 8. In this manner, a closed tunnel 7, 8, 14, 15, 16 enclosing the carousel 7,8 has been formed.

The O-rings 17 and 18 may be in the form of sliding seals, for instance fitted with rubber lip(s), or for instance, they also may be contact-free labyrinth seals.

The shown processing sites 12 are designed to receive plastic bottles fitted with collars. However, they also may be designed for other containers such as glass bottles or metal cans, in which event, the supports 11 would be replaced by appropriately lowered saucers receiving the containers.

The feed of bottles 1 to, and their removal from, the filling machine shown in FIGS. 1 and 2 is carried out conventionally using a conveyor element 19, which transfers the bottles 1 from narrow sockets (not shown) to an intake wheel 20. Seizing said bottles by their collars 2, said wheel 20, in turn, transferring said bottles to the processing sites 12 of the filling machine. At the exit side, the bottles are accepted in corresponding manner by a removal wheel 21 and moved to a removing conveyor element 22.

In this zone, the component 14 remains unchanged, however, the remaining parts 15', 16' of the stationary wall are widened outward as indicated in FIGS. 1 and 2. Accordingly, the wheels 20 and 21 are received in a widening of the tunnel, with the shafts 23 of the wheels 20 and 21 crossing the stationary wall 15' while being sealed relative to it by an O-ring 24.

The conveyor elements 19 and 22 run into, and out of, the space enclosed by the stationary surfaces. For this purpose, apertures (not shown) are provided that reduce exchanges between the atmospheres, for instance using container sluices. One connector each 25 and 26 is respectively provided in the regions of the wheels 20 and 21 at the stationary wall segment 14. By means of one of said connectors, the special atmosphere, such as sterile air, $CO_2$ or $H_2O_2$ or the like, may be admitted by blowing, and may be removed by suction through the other connector, in order to always maintain the quality of the special atmosphere and to compensate for any losses.

Where the space is widened, and at the location of the wheels 20, 21, namely between them, a blocking partition 27 may be provided between said wheels, though it shall be fitted with passages for the processing sites 12. In this manner, circulation is constrained between the connectors 25 and 26 around the tunnel.

If sealing machinery follows the shown filling machine, then said sealing machinery may comprise an angular space of corresponding structure. Illustratively, the removing conveyor element 22 of the shown filling machine constituting the feed conveyor element 19 of the subsequent machinery and these being configured directly adjacent to the stationary walls.

FIGS. 3 and 4 show variations in the tunnel design to receive the processing sites 12. The same reference numerals are used as in FIGS. 1 and 2.

FIG. 3 shows a carousel without the cylindrical wall 8 of the embodiment mode of FIG. 1. The tunnel around the processing sites 12 is constituted by a stationary wall having wall surfaces 14, 15 and 16, which by means of O-rings 17 and 18 directly seal off the annular wall 7 from below.

FIG. 4 does not have the above annular wall 7. The cylindrical wall 8 in this design constitutes the peripheral wall of a kettle peripherally fitted with flanged filling elements 9. By means of the O rings 17 and 18, the stationary walls 14, 15 and 16 are sealed relative to the cylindrical wall 8.

Further variations of the tunnel design are conceivable, but are not shown.

What is claimed is:

1. A rotating processing machine for beverage containers (1), comprising a carousel (7, 8) revolving about a vertical axis (5) and fitted with peripherally spaced processing sites (12) receiving the containers, the processing sites being configured in a closed space that can be loaded with a special atmosphere, said space's stationary surfaces (14, 15, 16) being traversed by entry and exit conveyor elements (19, 22), wherein said closed space is structured as an annular tunnel (7, 8, 14, 15, 16) surrounding the carousel (7, 8) and being enclosed, on one hand, by closed carousel surfaces (7, 8) and, on the other hand, by the stationary surfaces (14, 15, 16), the carousel surfaces and stationary surfaces subtending said tunnel sealing each other off by means of two seals (17, 18) that are concentric with the axis (5).

2. The processing machine as claimed in claim 1, further comprising entry and exit wheels (20, 21), said wheels (20, 21) being located in a tunnel widening that is enclosed by the stationary surfaces (15', 16').

3. A rotary processing machine for beverage containers (1), comprising a carousel (7, 8) which revolves about a vertical axis (5) and is fitted with peripherally spaced processing sites (12) receiving the containers, the processing sites being configured in a sealed space that can be loaded with a special atmosphere, the stationary surfaces (14, 15, 16) of said space being traversed by entry and exit conveyor elements (19, 22), wherein said space assumes the shape of an annular tunnel (7, 8, 14, 15, 16) surrounding the carousel (7, 8), said space being enclosed, on one hand, by the closed carousel surfaces (7, 8) and, on the other hand by the stationary surfaces (14, 15, 16), wherein the carousel surfaces and the stationary surfaces seal off each other by means of two seals (17, 18) concentric with the axis (5) and wherein two connectors (25, 26) guiding a special atmosphere are mounted in the stationary surface (14), wherein one connector (25) is designed to feed the special atmosphere and is mounted in the zone of the entry conveyor element (19) and the other connector (26) is designed to discharge the special atmosphere and is mounted in the zone of the exit conveyor element (22), and wherein, in order to constrain circulation around said annular tunnel (7, 8, 14, 15, 16) between said conveyor elements (19, 22), a partition (27) is configured between said conveyor elements (19, 22) and divides the annular tunnel (7,8, 14, 15', 16') and is fitted with apertures for the processing sites (12).

4. The processing machine as claimed in claim 3, further comprising entry and exit wheels (20, 21), said wheels (20, 21) being located in a tunnel widening that is enclosed by the stationary surfaces (15', 16').

* * * * *